United States Patent [19]

Hansson et al.

[11] Patent Number: 4,458,416

[45] Date of Patent: Jul. 10, 1984

[54] VIBRATION DAMPED PORTABLE IMPACT TOOL

[75] Inventors: Gunnar C. Hansson, Stockholm; Per A. L. Gidlund, Täby, both of Sweden

[73] Assignee: Atlas Copco Aktiebolag, Nacka, Sweden

[21] Appl. No.: 390,544

[22] Filed: Jun. 21, 1982

[30] Foreign Application Priority Data

Jun. 24, 1981 [SE] Sweden ..... 8103951

[51] Int. Cl.[3] ..... B26B 3/00

[52] U.S. Cl. ..... 30/168; 30/169; 30/277; 173/139

[58] Field of Search ..... 173/139; 30/168, 169, 30/172, 277, 345

[56] References Cited

U.S. PATENT DOCUMENTS

| | | | |
|---|---|---|---|
| 1,617,924 | 2/1927 | Russel | 30/272 R |
| 2,634,499 | 4/1953 | Bowes | 30/345 |
| 2,655,921 | 10/1953 | Haboush | 30/168 |
| 3,496,973 | 2/1970 | Ballard | 30/345 |

FOREIGN PATENT DOCUMENTS

| | | |
|---|---|---|
| 2010726 | 7/1979 | United Kingdom . |
| 1579333 | 11/1980 | United Kingdom . |

*Primary Examiner*—Frank T. Yost
*Assistant Examiner*—Hien H. Phan
*Attorney, Agent, or Firm*—Frishauf, Holtz, Goodman & Woodward

[57] ABSTRACT

A vibration damped portable impact tool comprising a pneumatically powered reciprocating mechanism to which a chisel is connected. In the disclosed tool the chisel is rigidly connected to the piston of the reciprocating mechanism so as to move conjointly therewith. The drive mechanism is arranged in a previously known manner to absorb its own acceleration forces whereby the only vibration forces acting on the tool derive from the chisel in its contact with the work piece. By adapting the spring constant relating to bending of the chisel to the entire mass of the tool such that the resonance frequency of that system is lower than the impact frequency, the vibration forces arising at the working end of the chisel are not transmitted to the tool housing.

3 Claims, 4 Drawing Figures

VIBRATION DAMPED PORTABLE IMPACT TOOL

BACKGROUND OF THE INVENTION

The present invention relates to a vibration damped portable impact tool. In particular, the invention concerns an impact tool provided with a power operated reciprocating mechanism to which is connected the rear neck portion of an elongated reciprocating working implement.

The invention intends to solve the problem concerning vibrations caused by the working implement at its contact with the work piece. Particularly, the invention intends to accomplish a substantial reduction of the vibrations occurring when working a surface located in an oblique angle to the impact direction of the tool. This is the case for instance when trimming welded seams with a chisel. The reciprocating movement that is induced longitudinally in the working implement is partly transferred at the forward end of the working implement into transversly directed impacts. These transversly directed impacts cause the forward end of the working implement to move in a transverse direction and, thereby, cause the entire impact tool to perform a rotating or pivoting movement about its center of rotation. This rotative reciprocating movement is repeated during each working cycle and causes a very annoying vibration of the tool.

The above described problem is solved by the invention as it is defined in the claims.

DETAILED DESCRIPTION

Figure 1:
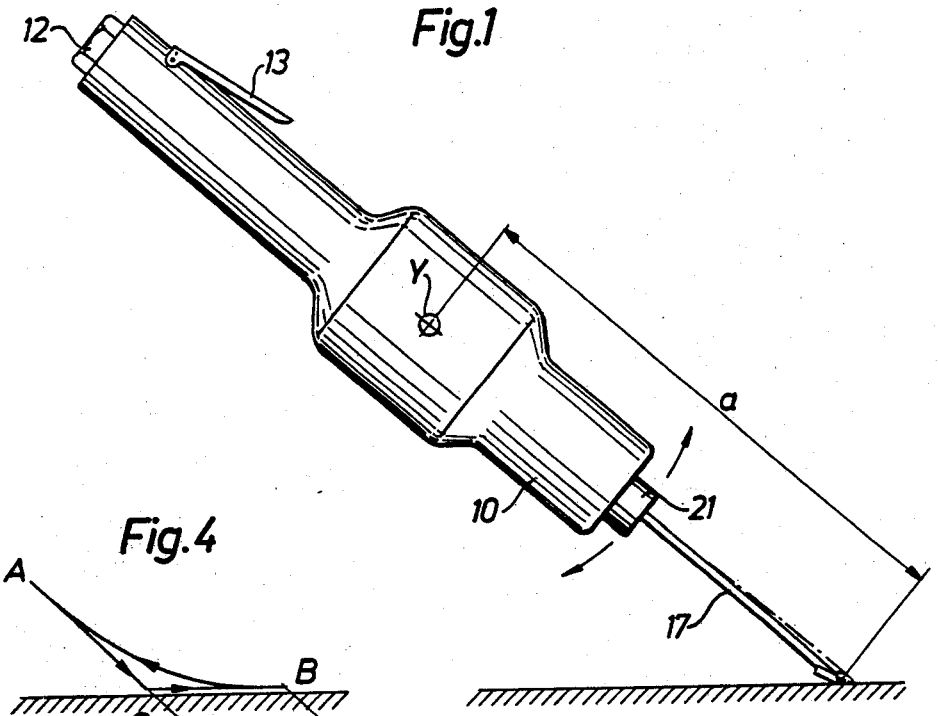
FIG. 1 shows an impact tool according to the invention in a slanted working position relative to the work piece.

The impact tool shown on the drawing is pneumatically powered and comprises a housing 10 guidingly supporting a reciprocating piston 11.

At its rear end, the tool housing 10 is provided with a pressure air conduit connection 12. The pressure air supply to the tool is controlled by a throttle valve (not shown) which is operated by a lever 13.

The reciprocating impact mechanism of the shown tool does not in itself form part of the invention and is not described in detail. It is important to notice, however, that the present invention will be purposful only when applied on a vibration damped impact device, because otherwise the longitudinal vibrations in the tool will dominate completely and make the vibration elimination according to this invention meaningless.

A vibration damped reciprocating mechanism suitable for a tool according to this invention is disclosed in U.S. Pat. No. 4,355,564 (corresponding to Ser. No. 134,761).

The reciprocating piston 11 is formed with an axial slot 15 at its forward end to receive therein the rear neck portion 16 of a working implement 17. The working implement comprises a chisel of rectangular cross section which rests with its rear end against the bottom of the slot 15 in the piston 11. The working edge of the chisel 17 is formed by a tungsten carbide insert 18. At its forward end the piston 11 comprises an outer conical surface 19 which is arranged to cooperate with an inner conical surface 20 of a cylindrical compression sleeve 21. The latter is threaded onto the forward end of the piston 11 so as to establish interengagement of the conical surfaces 19, 20. When tightening the compression sleeve 21 relative to the piston 11 the chisel 17 is rigidly clamped in the slot 15.

At its forward end, the housing 10 is formed with a central aperture 22 carrying a bushing 23 in which the outer surface of the compression sleeve 21 is guided. The compression sleeve 21 has the double purpose of locking the chisel 17 relative to the piston 11 and to serve as a bearing means between the piston 11 and the housing 10.

Between an internal shoulder 24 in the forward part of the housing 10 and an oppositely directed shoulder 25 on the piston 11 there is mounted a coil spring 26 the purpose of which is to apply a backward directed force on the piston 11. In FIG. 1 the impact tool is illustrated in its working position relative to a work piece. Thereby, the tool is supported in an oblique angle to the surface being worked, and the forward end of the chisel 17 is slided somewhat along the surface being worked at each reciprocating cycle. Such sliding movement is illustrated in FIG. 1 in that the forward end of the chisel is shown in dotted lines in a bent aside position.

Figure 4:
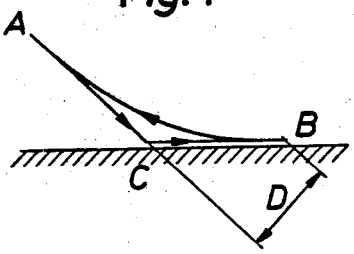
FIG. 4 illustrates schematically the movement pattern of the working edge of the working implement.
Figure 2:
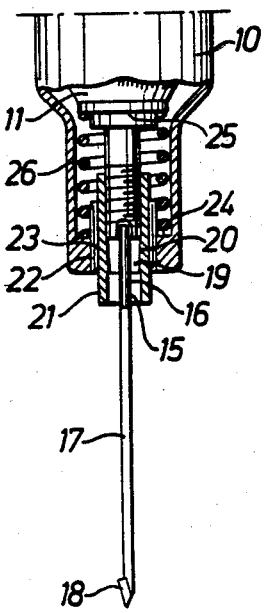
FIG. 2 shows, partly in section, the forward part of an impact tool according to the invention.
Figure 3:
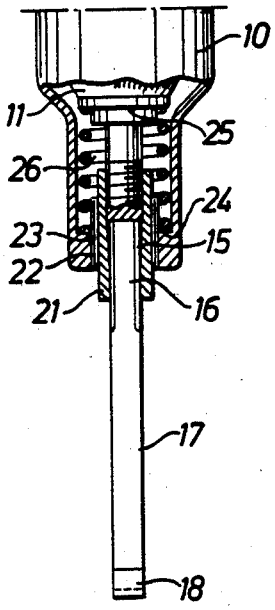
FIG. 3 shows a similar view as in FIG. 2 showing the tool turned 90 degrees.

In FIG. 4 there is schematically illustrated the movement pattern of the working edge of the chisel 17. In this illustration, A designates the rest position of the chisel and B the ultimate position thereof at the end of the stroke. At C the working edge hits the work piece, and due to the oblique angle between the impact direction and the surface of the work piece the working edge is slid aside a distance D. This is the amplitude of the vibration generating movement which tends to rotate the entire impact tool intermittently about its center of rotation Y. Arrows in FIG. 1 illustrate the vibration movement induced in the tool.

In order to prevent the vibration generating movement of the chisel working edge from being transmitted to the tool housing 10 the impact tool according to the invention comprises a chisel having a spring constant which is low enough to permit the forward end of the chisel to be elastically bent aside without the tool housing being affected thereby. At least, the spring constant is low enough in the direction perpendicular to the working edge of the chisel 17.

The principle on which the vibration damping system according to the invention is based refers to a mass-spring system in which the spring is formed by the chisel itself and the mass is mainly represented by the impact mechanism and the tool housing 10. The spring constant of the chisel is of great importance for the outcome of the vibration damping. The spring constant of the chisel must be chosen in relation to the mass of the tool such that the resonance frequency of the tool will be considerably lower than the impact frequency of the reciprocating mechanism, which is equal to the frequency of the vibration generating movement of the chisel edge. The resonance frequency of the system is determined by the expression:

$$\omega_r = \sqrt{\frac{k \cdot a^2}{J}}$$

wherein

J = the moment of inertia of the tool around Y k = the spring constant of the chisel, and a = the distance between the working edge of the chisel and the center of rotation Y of the tool In the previous description and on the drawings there is described an impact tool in which the chisel is rigidly connected to the reciprocating piston 11 of the impact device. The invention is, however, not particularly restricted to that type of energy transfer between the reciprocating mechanism and the chisel. The invention could as well be utilized in connection with impact tools having a hammer piston arranged to deliver blows directly or indirectly on the rear end of the chisel.

The chisel of the described and illustrated embodiment is of rectangular cross section. In some cases, however, it could be beneficial to use other types of chisels where the elastic resiliency should not only be one way directed. The chisel may have a square or circular cross section, dependent on the particular type of work the impact tool is going to perform. When for example working a weld seam between two parts arranged at right angles relative to each other a circular chisel cross section would be preferred, because such a chisel would have resilient properties to absorb vibration generating sliding movements of the chisel edge in more than one transverse direction.

We claim:

1. A vibration damped portable impact tool comprising:

a power operated reciprocating mechanism operable at a given operation frequency; and an elongated working implement which comprises a rear neck portion connected to the reciprocating mechanism and a forward rigid working portion formed with a straight working edge extending transversely to the longitudinal direction of said working implement;

said working implement being elastically bendable between said neck portion and said working portion in a direction transverse to the longitudinal directions of both said working implement and said working edge and having a spring constant which is related with the moment of inertia of the tool so as to form therewith a spring-mass vibration damping system having a resonance frequency that is lower than the operation frequency of the reciprocating mechanism.

2. Impact tool according to claim 1, wherein said working portion comprises a tungsten carbide insert.

3. Impact tool according to claim 1 or 2, wherein said working implement has a smaller cross sectional dimension in said bending direction than in other directions.

* * * * *